US006945360B2

(12) United States Patent
Sullivan, Jr.

(10) Patent No.: US 6,945,360 B2
(45) Date of Patent: Sep. 20, 2005

(54) MODULAR LADDER ASSEMBLY

(76) Inventor: Sidney J. Sullivan, Jr., 1218 Plainview Rd., P.O. Box 514, Hornbeck, LA (US) 71439

( * ) Notice: Subject to any disclaimer, the term of this patent is extended or adjusted under 35 U.S.C. 154(b) by 104 days.

(21) Appl. No.: 10/366,326

(22) Filed: Feb. 14, 2003

(65) Prior Publication Data

US 2003/0159885 A1 Aug. 28, 2003

Related U.S. Application Data

(60) Provisional application No. 60/359,994, filed on Feb. 28, 2002.

(51) Int. Cl.[7] ..... E04G 1/34

(52) U.S. Cl. ..... 182/151; 182/22; 256/59

(58) Field of Search ..... 182/151, 22, 20, 182/120, 129, 178.4, 179, 181, 187, 104–116, 156, 194; 256/59

(56) References Cited

U.S. PATENT DOCUMENTS

| | | | | | |
|---|---|---|---|---|---|
| 16,883 | A | * | 3/1857 | Giambastiani | 83/490 |
| 213,686 | A | * | 3/1879 | Phillips | 256/1 |
| 296,419 | A | * | 4/1884 | Magnus | 182/104 |
| 763,757 | A | | 6/1904 | Hopkins | |
| 830,485 | A | | 9/1906 | Norton | |
| 965,712 | A | | 7/1910 | Holdridge | |
| 1,466,757 | A | * | 9/1923 | Riemer | 182/116 |
| 1,757,912 | A | * | 5/1930 | Langlois | 182/113 |
| 2,718,346 | A | * | 9/1955 | Galen | 182/104 |
| 3,744,591 | A | * | 7/1973 | Lucci et al. | 182/156 |
| 4,428,456 | A | | 1/1984 | Rohde | |
| 4,478,549 | A | * | 10/1984 | Stelly et al. | 414/537 |
| 4,842,098 | A | * | 6/1989 | Yuen | 182/22 |
| 4,875,673 | A | * | 10/1989 | Erickson | 482/55 |
| 4,917,216 | A | * | 4/1990 | Kimber | 182/151 |
| 5,012,893 | A | | 5/1991 | Kraeger | |
| 5,555,954 | A | * | 9/1996 | Swiderski | 182/152 |
| 5,638,918 | A | * | 6/1997 | Hebda et al. | 182/151 |
| 5,791,436 | A | * | 8/1998 | Talley, Sr. | 182/116 |
| 5,853,281 | A | * | 12/1998 | Farmer | 414/537 |
| 5,967,258 | A | * | 10/1999 | Scott et al. | 182/113 |
| 6,189,653 | B1 | * | 2/2001 | Laug | 182/152 |
| 6,318,498 | B1 | * | 11/2001 | Warner | 182/164 |
| 2003/0146426 | A1 | * | 8/2003 | Ray et al. | 256/59 |

FOREIGN PATENT DOCUMENTS

| | | | | |
|---|---|---|---|---|
| GB | 2244753 | * | 3/1990 | 182/151 |
| GB | 2341883 | * | 6/1999 | 182/151 |

* cited by examiner

*Primary Examiner*—Bruce A. Lev
(74) *Attorney, Agent, or Firm*—Lowe Hauptman Gilman and Berner, LLP

(57) ABSTRACT

A modular ladder assembly includes at least two ladder assemblies, each assembly having first and second parallel stiles and a plurality of spaced apart rungs disposed between the first and second stiles, the plurality of rungs being perpendicular to said first and second stiles. The first stiles of the at least two ladder assemblies are mechanically connected together and at least one adjustment assembly is mechanically connected to the second stile of one of the at least two ladder assemblies and a second end of at least one adjustment assembly is mechanically connected to a second stile of a second of the at least two ladder assemblies so that the at least two ladder assemblies and the at least one adjustment assembly have a triangular shape when viewed from a plane perpendicular to the first and second stiles of the at least two ladder assemblies.

32 Claims, 6 Drawing Sheets

MODULAR LADDER ASSEMBLY

CROSS-REFERENCE TO RELATED APPLICATIONS AND CLAIM OF PRIORITY

The present application relates to Provisional Application Ser. No. 60/359,994, filed in the U.S. Patent and Trademark Office on Feb. 28, 2002 and the benefit of priority based on this provisional application is hereby claimed.

BACKGROUND OF THE INVENTION

1. Field of the Invention

The present invention relates generally to modular ladder assemblies, and more particularly, to a triangulated modular ladder assembly and to various arrangements using one or more of the modular ladder assemblies.

2. Description of the Related Art

The dictionary definition of a ladder is a framework of two long structural members connected at regular intervals by parallel rungs for climbing or descending. The difficulty with such a typical ladder is that it easily becomes unstable. Many accidents occur due to this instability.

U.S. Pat. No. 2,718,346 to Galen discloses a triangulated ladder consisting of two ladder assemblies joined by hinges and a pair of toggle arms. As illustrated in the drawing figures thereof, Galen discloses a ladder comprising a pair of sections each of which include a pair of laterally spaced stiles tapering upwardly to form a wide base and a narrow top rather than ladder assemblies each having parallel stiles.

Furthermore, Galen discloses hinges that are not separable rather than hinges that are separable via an easily removable hinge pin. Still furthermore, as illustrated in FIGS. 4–6 of Galen and stated in the paragraph beginning on line 25 of column 2 thereof, the toggle arms each consist of toggle elements 19 and 20 pivotally secured by means of a bolt or rivet 21 to a substantially U-shaped sheet metal hinge element 22 rather than having rigid members.

Moreover, Galen discloses only a single pair of ladder assemblies rather than coupling the respective ends of the stiles of two or more pairs of ladder assemblies to form a triangulated ladder having a length greater than that of a triangulated ladder formed of a single pair of ladder assemblies. Lastly, Galen discloses fixed length members (that is, toggle arms) rather than adjustable length members (that is, toggle arms) to facilitate adjustment of the angle between the pair of ladder assemblies.

U.S. Pat. No. 5,012,893 to Kraeger discloses a sawhorse having three sets of outwardly folding legs that are held in the open position by three pair is attached braces which are in turn attached to a bar that runs parallel to the beam of the sawhorse. As illustrated in FIG. 1 of Kraeger, the disclosed sawhorse comprises a beam having three unitary legs extending outward therefrom and three movable legs permanently attached thereto by hinges, rather than a pair of ladder assemblies, each ladder assembly consisting of two parallel stiles having a plurality of parallel rungs disposed therebetween.

Furthermore, the members (that is, braces) of Kraeger are foldable, each being formed of two elements having a hinge disposed therebetween, rather than having rigid members.

Still furthermore, Kraeger discloses fixed length members (that is, braces, rather than adjustable length members. Moreover, Kraeger discloses only a single pair of ladder assemblies rather than the use of a coupling arrangement to couple the respective ends of the stiles of two or more pairs of ladder assemblies to form a triangulated ladder having a length greater than that of a triangulated ladder formed of a single pair of ladder assemblies.

U.S. Pat. No. 4,428,456 to Rohde discloses a collapsible lookout tower that is triangular in cross-section and tapers inwardly from the bottom to the top. The tower has an upper and lower section and can be easily and quickly disassembled and the sections nested for easy transportation and storage.

As illustrated in FIG. 1 of Rohde, Rohde discloses a tower in which the upper and lower sections are each formed of three vertical members that taper inwardly from the bottom to the top, rather than a pair of ladder assemblies, each ladder assembly having two parallel stiles.

Furthermore, the three vertical members of each section of Rohde are joined together by horizontal cross members that are bolted to the three vertical members, rather than one stile of one of the ladder assemblies being attached to one stile of the other of the ladder assemblies by means of at least one pair of hinge assemblies, each hinge assembly including an easily removable hinge pin. Lastly, Rohde discloses fixed length members (that is, cross members) rather than adjustable length members (that is, cross members) to facilitate adjustment of the angle between the pair of ladder assemblies.

U.S. Pat. No. 4,478,549 to Stelly et al. discloses a foldable loading ramp consisting of a pair of ladder-like assemblies joined together by a pair of hinges.

Stelly et al. discloses hinges that are not separable rather than hinges that are separable via an easily removable hinge pin.

Furthermore, Stelly et al. discloses only a single pair of ladder assemblies rather than the use of a coupling arrangement to couple the respective ends of the stiles of two or more pairs of ladder assemblies to form a triangulated ladder having a length greater than that of a triangulated ladder formed of a single pair of ladder assemblies.

U.S. Pat. No. 1,466,757 to Riemer discloses a folding ladder having a pair of ladder assemblies that are permanently joined together by a pair of hinges. Riemer discloses hinges that are not separable rather than hinges that are separable via an easily removable hinge pin.

Furthermore, Riemer discloses the use of a single platform to join the pair of ladder assemblies rather than a pair of ladder assemblies being joined by at least one pair of rigid members to form a triangulated ladder. Moreover, Riemer discloses only a single pair of ladder assemblies rather than the use of a coupling arrangement to couple the respective ends of the stiles of two or more pairs of ladder assemblies to form a triangulated ladder having a length greater than that of a triangulated ladder formed of a single pair of ladder assemblies.

U.S. Pat. Nos. 763,757, 830,485, and 965,712 to Hopkins, Norton, and Holdridge, respectively, each disclosed other ladder arrangements that are not as pertinent as the patents discussed in detail above.

SUMMARY OF THE INVENTION

It is an object of the present invention to provide a more stable ladder and scaffolding system than is presently available.

These and other objects of the present invention can be achieved by providing a modular ladder assembly including: at least two ladder assemblies, each assembly having first and second parallel stiles and a plurality of spaced apart rungs disposed between said first and second stiles, said plurality of rungs being perpendicular to said first and second stiles; at least one adjustment assembly having first and second ends; at least one first type of fastener arrangement; and at least two second type of fastener arrangements; wherein respective first stiles of said at least two ladder assemblies are mechanically connected together by said at least one first type of fastener arrangement; and wherein said first end of said at least one adjustment assembly is mechanically connected to said second stile of one of said at least two ladder assemblies by one of said at least two second type of fastener arrangements and wherein said second end of said at least one adjustment assembly is mechanically connected to said second stile of a second of said at least two ladder assemblies by a second of said at least two second type of fastener arrangements so that said at least two ladder assemblies and said at least one adjustment assembly have a triangular shape when viewed from a plane perpendicular to said first and second stiles of said at least two ladder assemblies.

These and other objects of the present invention can be achieved by providing a method of manufacturing a modular ladder assembly, the method including: fabricating at least two ladder assemblies, each assembly having first and second parallel stiles and a plurality of spaced apart rungs disposed between said first and second stiles, said plurality of rungs being perpendicular to said first and second stiles; mechanically connecting together respective first stiles of said at least two ladder assemblies with at least one first type of fastener arrangement; mechanically connecting a first end of at least one adjustment assembly to said second stile of one of said at least two ladder assemblies with one of at least two second type of fastener arrangements; and mechanically connecting a second and of said at least one adjustment assembly to said second stile of a second of said at least two ladder assemblies by a second of said at least two second type of fastener arrangements; wherein said at least two ladder assemblies and said at least one adjustment assembly have a triangular shape when viewed from a plane perpendicular to said first and second stiles of said at least two ladder assemblies.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION

Figure 1:
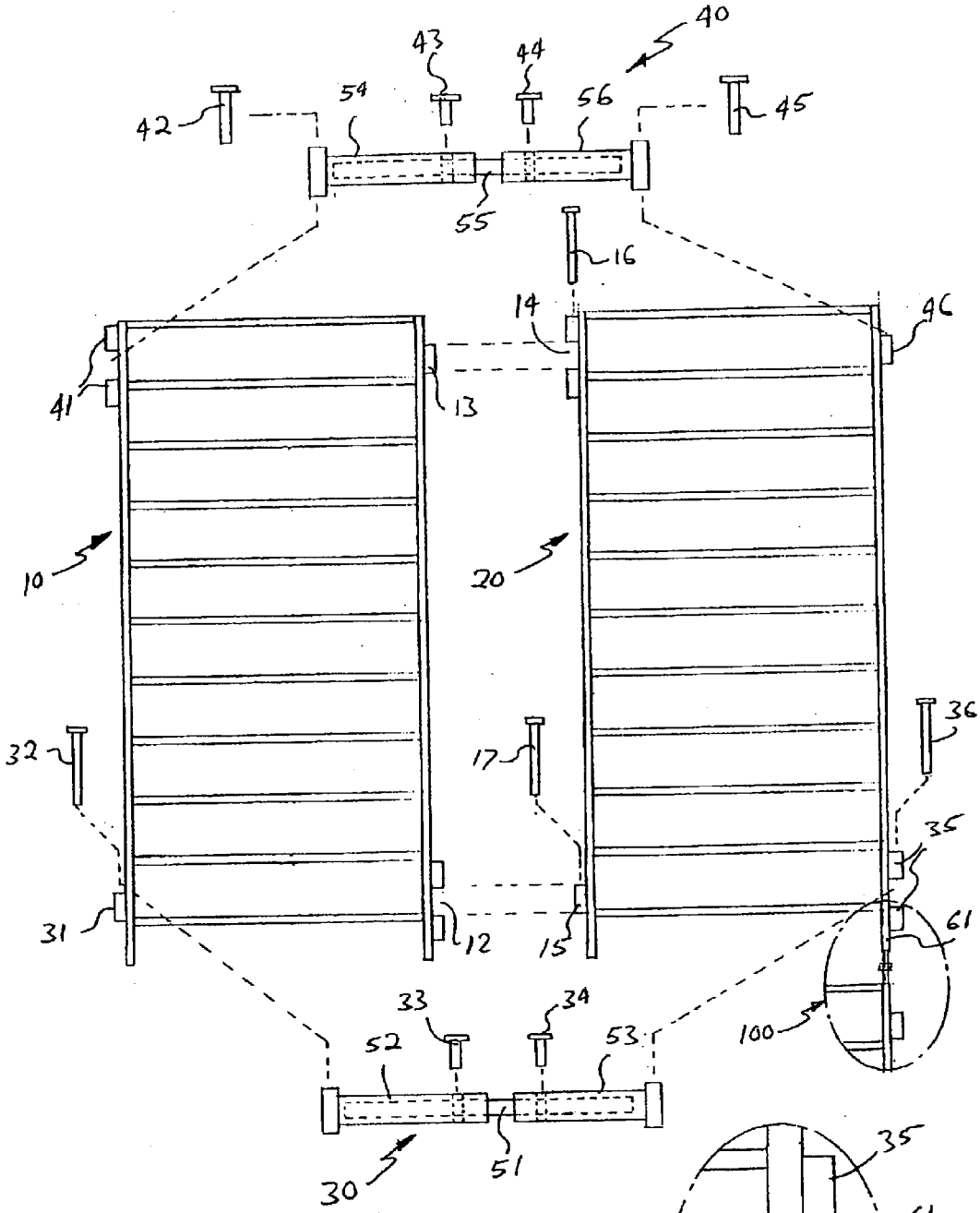
FIG. 1 is an exploded plane view of a ladder assembly and a pin for stacking sections according to an embodiment of the present invention.

FIG. 1 is an exploded view of a modular ladder assembly in accordance with an embodiment of the present invention. Two modular ladder assemblies 10 and 20 are held together using two hinge assemblies 12–15 and pins 16 and 17 to form an apex. Two adjustment assemblies 30 and 40 are used to adjust the angle or size of the triangle that the ladder forms. That is, adjustment assembly 30 includes assemblies 52 and 53 and assembly 51 that telescopes into assemblies 52 and 53.

The ladder assemblies 10 and 20 and the adjustment assemblies 30 and 40 can be fabricated of any suitable material and of any suitable cross-section commensurate with their application. For example, they can be fabricated of steel or aluminum or of a plastic such as PVC and can either be solid or hollow, depending on their application. Furthermore, they can have a circular or oval or square or rectangular cross-section, for example, depending on their application. Lastly, the ladder assemblies 10 and 20 can be fabricated of one material and cross-section that is different from the material and cross-section of the adjustment assemblies 30 and 40, for example.

Assemblies 51–53 have a plurality of spaced apart holes to allow pins 33 and 34 to fix the length of assembly 30 after adjustment thereof by telescoping assembly 51 into assemblies 52 and 53. Similarly, adjustment assembly 40 of includes assemblies 54–56 and pins 43 and 44.

One end of adjustable assembly 30 is affixed to modular ladder assembly 10 via a hinge arrangement 31 and pin 32. The other end of adjustable assembly 30 is affixed to modular ladder assembly 20 via a hinge arrangement 35 and pin 36. Similarly, the ends of adjustable assembly 40 are respectively affixed to modular ladder assemblies 10 and 20 via hinge arrangements 41 and 46 and pins 42 and 45.

Figure 1A:
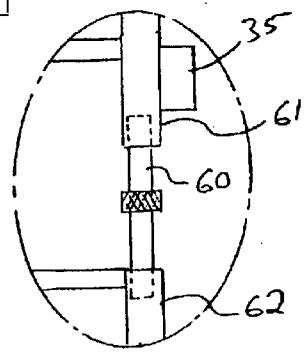
FIG. 1A is a magnified view of the area 100 of FIG. 1.
Figure 2A:
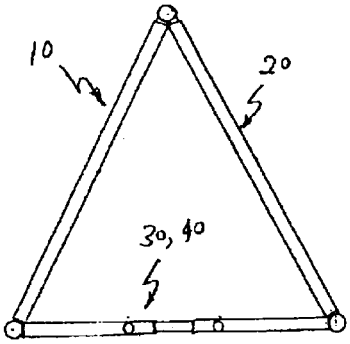
FIGS. 2A–2D are illustrations of how the ladder assembly can be adjusted to various angles using the angle adjustment assembly illustrated in FIG. 1.
Figure 2B:
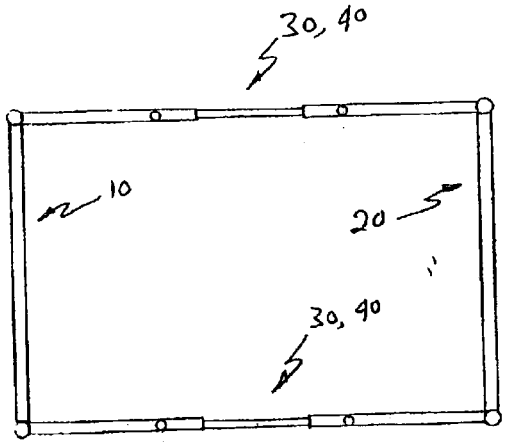
Figure 2C:
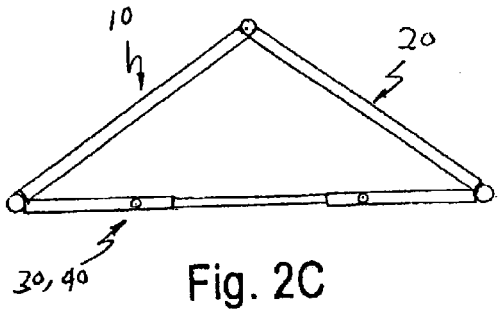

FIGS. 2A and 2C illustrate top views of the ladder assembly of FIG. 1. By adjusting adjustable assemblies 30 and 40, the angles of the resultant triangular shape can be varied. Furthermore, FIG. 1A is a magnified view of the area 100 of FIG. 1. By providing hinge or tube assemblies 61 and 62 and telescoping pin 60 that is arranged to connect assemblies 61 and 62, multiple modular assemblies 10 and 20 can be stacked together to produce a taller arrangement.

Figure 2D:
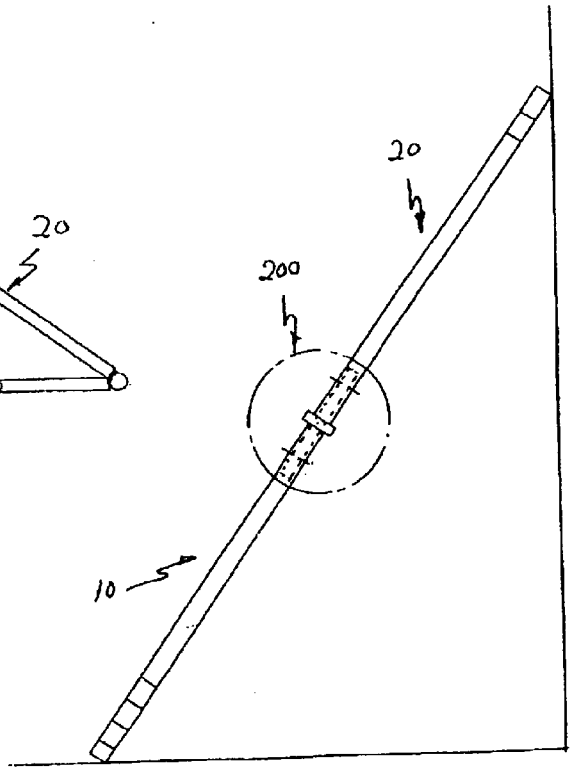
Figure 2E:
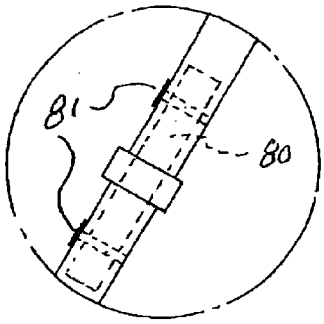
FIG. 2E is a magnified view of area 200 of FIG. 2D.

FIG. 2B illustrates an arrangement in which two sets of adjustable assemblies 30 and 40 are used to connect ladder assemblies 10 and 20 to produce a rectangular shape. FIG. 2D illustrates the ladder assemblies 10 and 20 connected together by pins 80 as illustrated in FIG. 2E (that is a magnified view of area 200 of FIG. 2D).

Safety pins 81 can be used to ensure that ladder assemblies 10 and 20 remained connected together. Similarly, such safety pins 81 can also be used with pin 60 as illustrated in FIG. 1A.

Advantageously, because of inherent the stability of the above noted modular ladder assemblies, such assemblies can be used, for example, to facilitate digging a hole, wherein one such assembly surrounds the hole being dug.

Figure 3A:
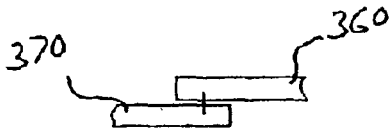
FIG. 3A is a magnified view of area 300 of FIG. 3.
Figure 3:
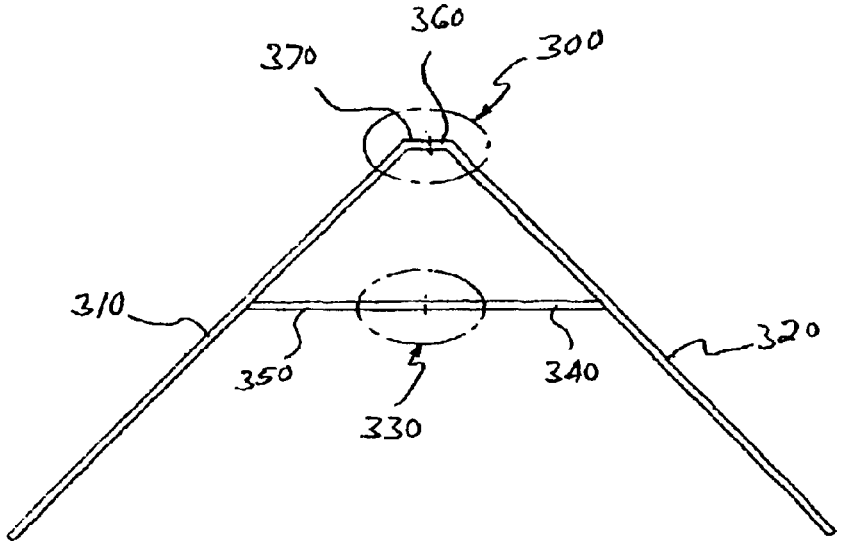
FIG. 3 is an illustration of a simplified, less costly ladder assembly in accordance with an embodiment of the present invention in which there is no adjustment assembly.
Figure 3B:
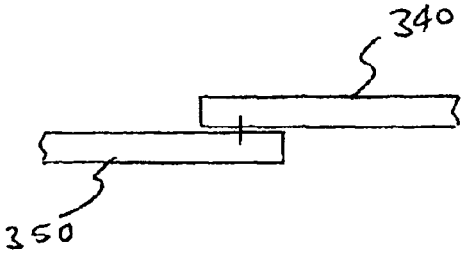
FIG. 3B is a magnified view of area 320 of FIG. 3.

FIG. 3 is an illustration of a simplified, less costly ladder in accordance with an embodiment of the present invention in which there is no adjustment assembly; FIG. 3A is a magnified view of area 300 of FIG. 3 and FIG. 3B is a magnified view of area 320 of FIG. 3. As illustrated therein, non-adjustable assemblies 370 and 360 connect ladder assemblies 310 and 320 together at the vertex therebetween. In some applications, a single assembly can replace non-adjustable assemblies 370 and 360. Alternatively, in other applications, non-adjustable assemblies 370 and 360 can be eliminated entirely by having ladder assemblies 310 and 320 directly connect together at their vertex as illustrated in the embodiment of FIG. 2A. Similarly, non-adjustable assemblies 340 and 350 connect ladder assemblies 310 and 320 together so as to form a triangular shape. As with non-adjustable assemblies 370 and 360, non-adjustable assemblies 340 and 350 can be replaced by a single assembly in some applications.

Figure 3C:
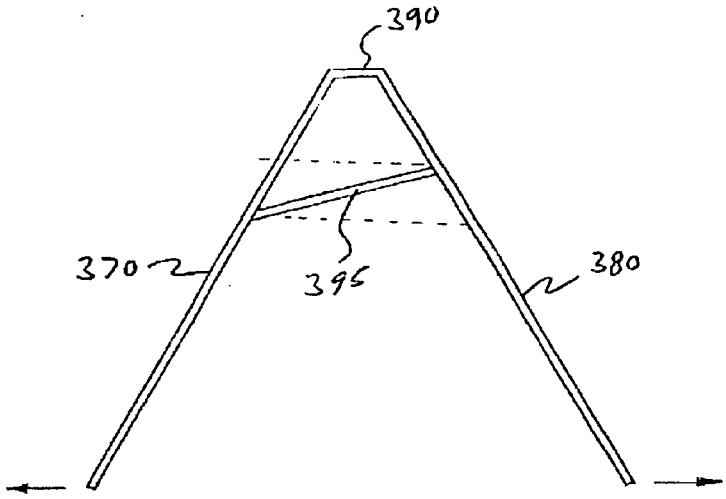
FIGS. 3C and 3D are illustrations of another less costly ladder assembly in accordance with an embodiment of the present invention in which there is an adjustment assembly.
Figure 3D:
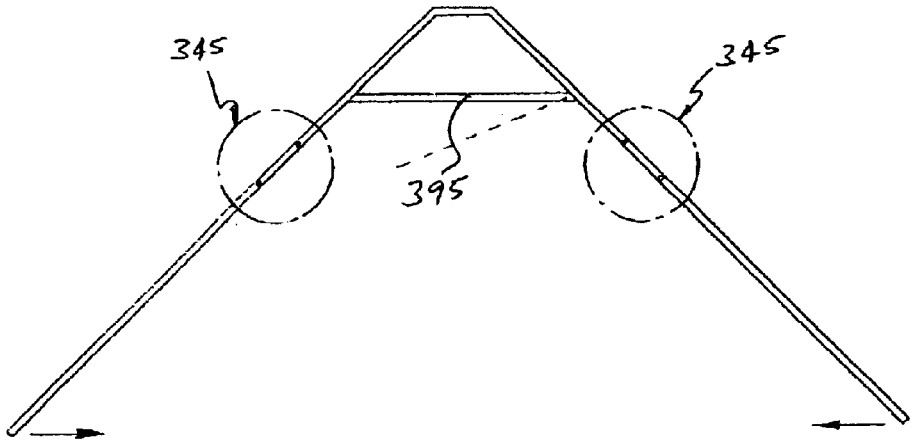
Figure 3E:
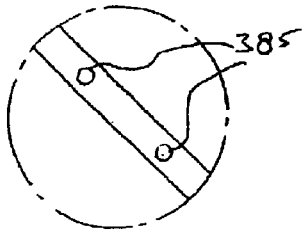
FIG. 3E is a magnified view of areas 345 of FIG. 3D.

FIGS. 3C and 3D are illustrations of another less costly ladder assembly in accordance with an embodiment of the present invention in which there is an adjustment assembly and FIG. 3E is a magnified view of areas 345 of FIG. 3D. As illustrated therein, non-adjustable assembly 390 connects ladder assemblies 370 and 380 together at the vertex therebetween and non-adjustable assembly 395 connects ladder assemblies 370 and 380 together so as to form a triangular shape. However, in this embodiment, by providing spaced holes 385 in ladder assemblies 370 and 380, it is possible to adjust the vertex angle between ladder assemblies 370 and 380 by selecting appropriate holes therein to affix the non-adjustable assembly 395 therebetween.

Figure 4:
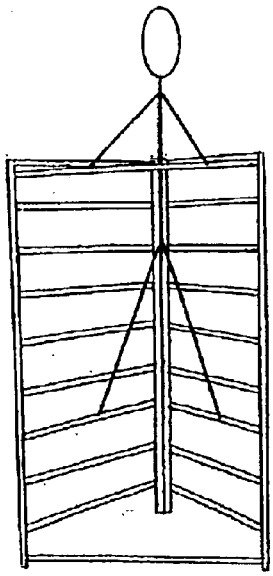
FIG. 4 is an illustration of a person standing inside the ladder grasping one of the adjustment assemblies.
Figure 5:
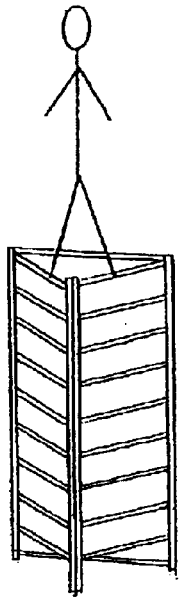
FIG. 5 is an illustration of a person standing on top of the ladder assembly.
Figure 6:
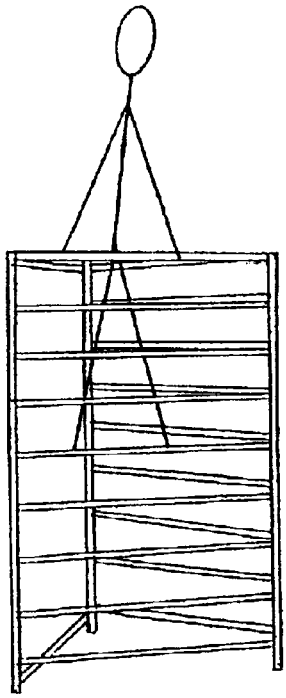
FIG. 6 is an illustration of a person standing on a ladder portion of the ladder assembly.
Figure 7:
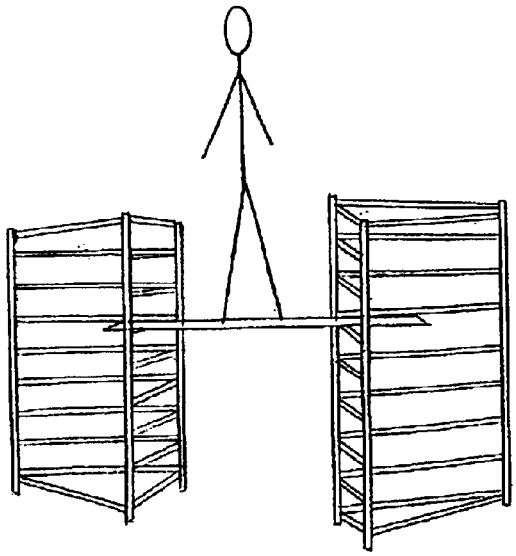
FIG. 7 is an illustration of two ladder assemblies being used as a scaffold with the person standing on the scaffold between the two ladder assemblies.
Figure 8:
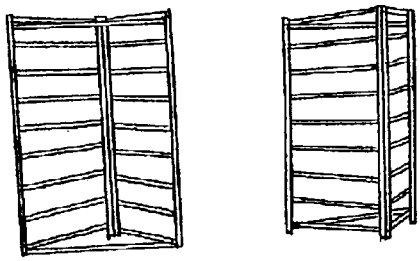
FIG. 8 is an illustration of two ladder assemblies.
Figure 9:
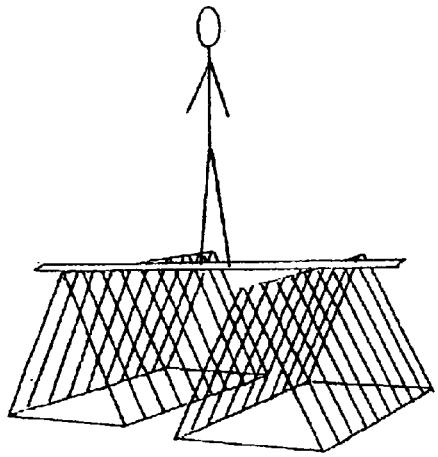
FIG. 9 is an illustration of two ladder assemblies placed on their side with a scaffold placed on top.
Figure 10:
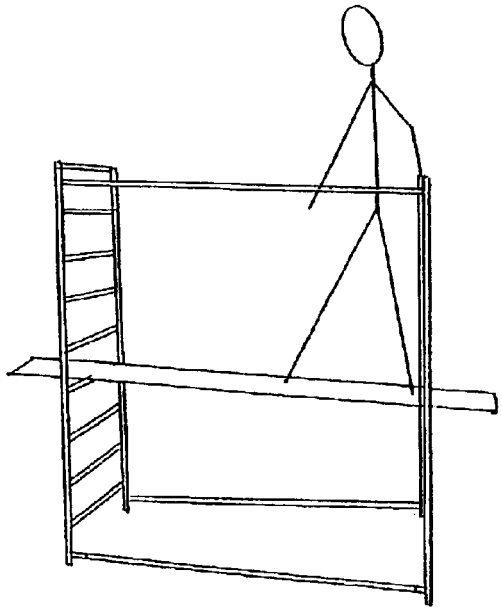
FIG. 10 is an illustration of two ladder sections being connected by two additional ladder sections with the ladder assembly being used as a scaffold.
Figure 11:
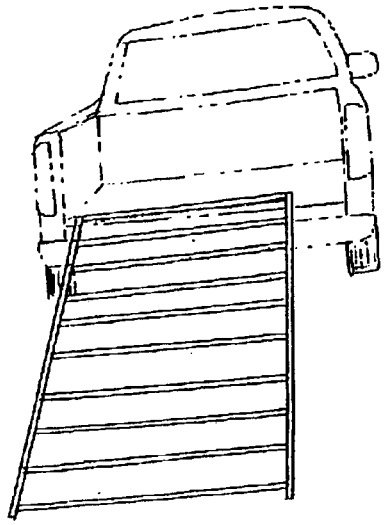
FIG. 11 is an illustration of one of the ladder assemblies being used as a ramp for a pick-up truck bed.

FIGS. 4–11 illustrate applications of the triangular ladder assembly in accordance with various embodiments of the present invention. For example, FIG. 4 illustrates a person standing inside the ladder assembly while grasping one of the adjustment assemblies. FIG. 5 illustrates a person standing on top of the ladder assembly. Similarly, FIG. 6 illustrates a person standing on a ladder portion of the ladder assembly and FIG. 7 illustrates two ladder assemblies being used as a scaffold with the person standing on the scaffold between the two ladder assemblies. Furthermore, FIG. 8 illustrates two ladder assemblies and FIG. 9 illustrates two ladder assemblies placed on their side with a scaffold placed on top. Still furthermore, FIG. 10 illustrates two ladder assemblies being connected by two additional ladder assemblies with the resultant assembly being used as a scaffold and FIG. 11 illustrates one of the ladder assemblies being used as a ramp for a pick-up truck bed.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein.

For example, while pins have been disclosed above as serving as the fastening means to fasten the various elements of a modular ladder assembly in accordance with the above described embodiments of the present invention, it is to be understood that the present invention is not limited thereto. That is, threaded bolts, for example, could easily be substituted for the pins disclosed above.

Furthermore, while two adjustment assemblies have been disclosed above as connecting the two ladder assemblies together, is to be understood that the present invention is not limited thereto. That is, the number of adjustment assemblies needed to connect the two ladder assemblies together varies in accordance with the application.

Lastly, while two hinge assemblies have been disclosed above as connecting respective stiles of the two ladder assemblies together, it is to be understood that the present invention is not limited thereto. That is, the number of hinge assemblies needed to connect the two ladder assemblies together varies in accordance with the application.

What is claimed is:

1. A modular ladder assembly adapted to be placed on a support surface comprising:

at least two ladder assemblies, each assembly having first and second parallel stiles and a plurality of spaced apart rungs disposed between said first and second stiles, said plurality of rungs being perpendicular to said first and second stiles;

at least one adjustment assembly having first and second ends;

at least one first type of fastener arrangement;

at least two second type of fastener arrangements;

wherein respective first stiles of said at least two ladder assemblies are mechanically connected together by said at least one first type of fastener arrangement and respective first stiles are parallel to each other; and wherein said first end of said at least one adjustment assembly is mechanically connected to said second stile of one of said at least two ladder assemblies by one of said at least two second type of fastener arrangements and wherein said second end of said at least one adjustment assembly is mechanically connected to said second stile of a second of said at least two ladder assemblies by a second of said at least two second type of fastener arrangements so that said at least two ladder assemblies and said at least one adjustment assembly have a triangular shape when viewed from a plane perpendicular to said first and second stiles of said at least two ladder assemblies; and wherein said modular ladder assembly has a folded position where said at least two ladder assemblies are substantially parallel to each other and a working position where said at least two ladder assemblies are substantially perpendicular to the support surface on which said two ladder assemblies are positioned, wherein at least one of said at least two ladder assemblies further comprises more than one attachment points to selectively connect said first of said at least one adjustment assembly to said second stile of one of said at least two ladder assemblies, the selection of attachment points determining a vertex angle between said at least two ladder assemblies.

2. The assembly of claim 1, wherein said at least one adjustment assembly has a variable length.

3. The assembly of claim 1, wherein said at least one adjustment assembly comprises at least two elements.

4. The assembly of claim 3, further comprising at least one third type of fastener arrangement to connect said at least two elements together.

5. The assembly of claim 4, wherein said at least one third type of fastener arrangement is arranged to connect said at least two elements together such that said at least one adjustment assembly has a variable length.

6. The assembly of claim 1, wherein said at least one first type of fastener arrangement comprises a hinge and pin assembly.

7. The assembly of claim 1, wherein said at least two second type of fastener arrangements each comprise a hinge and pin assembly.

8. The assembly of claim 4, wherein said at least one third type of fastener arrangement comprises an elongated element arranged to telescope into at least one of said at least two elements and at least two pins to respectively join said elongated element to said at least two elements.

9. The assembly of claim 1, wherein said at least two ladder assemblies comprise four ladder assemblies, and further comprising at least four forth type of fastener arrangements, each of said at least four forth type of fastener arrangements arranged to mechanically connect said first stile of one of said four ladder assemblies to said first stile of another of said four ladder assemblies so that said first stile of one of said four ladder assemblies is colinear with said first stile of another of said four ladder assemblies.

10. The assembly of claim 9, wherein said at least four forth type of fastener arrangements comprises an elongated element arranged to telescope into at least one of said first stile of one of said four ladder assemblies and said first stile of another of said four ladder assemblies and at least two pins to respectively join said elongated element to said first stile of one of said four ladder assemblies and said first stile of another of said four ladder assemblies.

11. The assembly of claim 1, wherein said at least two ladder assemblies are of a metal.

12. The assembly of claim 11, wherein said metal comprises one of steel or aluminum.

13. The assembly of claim 1, wherein said at least two ladder assemblies are of a plastic.

14. The assembly of claim 13, wherein said plastic comprises PVC.

15. The assembly of claim 1, wherein said at least two ladder assemblies comprise hollow tubing.

16. The assembly of claim 1, wherein said at least two ladder assemblies comprise solid rods.

17. A method of manufacturing a modular ladder assembly, the method comprising:

fabricating at least two ladder assemblies, each assembly having first and second parallel stiles and a plurality of spaced apart rungs disposed between said first and second stiles, said plurality of rungs being perpendicular to said first and second stiles;

mechanically connecting together respective first stiles of said at least two ladder assemblies with at least one first type of fastener arrangement;

mechanically connecting a first end of at least one adjustment assembly to said second stile of one of said at least two ladder assemblies with one of at least two second type of fastener arrangements; and mechanically connecting a second and of said at least one adjustment assembly to said second stile of a second of said at least two ladder assemblies by a second of said at least two second type of fastener arrangements;

wherein said at least two ladder assemblies and said at least one adjustment assembly have a triangular shape when viewed from a plane perpendicular to said first and second stiles of said at least two ladder assemblies;

wherein said modular ladder assembly has a folded position where said at least two ladder assemblies are substantially parallel to each other and a working position where said at least two ladder assemblies are substantially perpendicular to a support surface on which said two ladder assemblies are positioned, and wherein fabricating more than one attachment points on at least one of said at least two ladder assemblies to selectively connect said first end of said at least one adjustment assembly to said second stile of one of said at least two ladder assemblies, the selection of attachment points determining a vertex angle between said at least two ladder assemblies.

18. The method of claim 17, further comprising fabricating said at least one adjustment assembly so as to have a variable length.

19. The method of claim 17, further comprising fabricating said at least one adjustment assembly so as to have at least two elements.

20. The method of claim 19, further comprising mechanically connecting said at least two elements together with at least one third type of fastener arrangement.

21. The method of claim 20, further comprising connecting said at least two elements together with said at least one third type of fastener arrangement such that said at least one adjustment assembly has a variable length.

22. The method of claim 20, further comprising fabricating said at least one third type of fastener arrangement of an elongated element arranged to telescope into at least one of said at least two elements and at least two pins to respectively join said elongated element to said at least two elements.

23. The method of claim 17, further comprising fabricating said at least one first type of fastener arrangement of a hinge and pin assembly.

24. The method of claim 17, further comprising fabricating each of said at least two second type of fastener arrangements of a hinge and pin assembly.

25. The method of claim 17, wherein said at least two ladder assemblies comprise four ladder assemblies, and further comprising mechanically connecting said first stile of one of said four ladder assemblies to said first stile of another of said four ladder assemblies with a forth type of fastener assembly so that said first stile of one of said four ladder assemblies is colinear with said first stile of another of said four ladder assemblies.

26. The method of claim 25, further comprising fabricating said at least four forth type of fastener arrangements of an elongated element arranged to telescope into at least one of said first stile of one of said four ladder assemblies and said first stile of another of said four ladder assemblies and at least two pins to respectively join said elongated element to said first stile of one of said four ladder assemblies and said first stile of another of said four ladder assemblies.

27. The method of claim 17, further comprising fabricating said at least two ladder assemblies of a metal.

28. The method of claim 27, further comprising fabricating said at least two ladder assemblies of one of steel or aluminum.

29. The method of claim 17, further comprising fabricating said at least two ladder assemblies of a plastic.

30. The method of claim 28, further comprising fabricating said at least two latter assemblies of PVC.

31. The method of claim 17, further comprising fabricating said at least two ladder assemblies of hollow tubing.

32. The method of claim 17, further comprising fabricating said at least two ladder assemblies of solid rods.

* * * * *